United States Patent [19]

DeCaro et al.

[11] 4,249,887

[45] Feb. 10, 1981

[54] PHOTOFLASH LAMP HAVING GAP-FIRE IGNITION MOUNT, AND METHOD OF MAKING THE MOUNT

[75] Inventors: Aristide R. DeCaro, Edison; Rudolf F. Strobel, Union, both of N.J.

[73] Assignee: Westinghouse Electric Corp., Pittsburgh, Pa.

[21] Appl. No.: 866,154

[22] Filed: Dec. 30, 1977

[51] Int. Cl.[3] ..... F21K 5/02

[52] U.S. Cl. ..... 431/365; 29/25.16; 431/358

[58] Field of Search ..... 431/92, 93, 94, 95 R, 431/96; 313/315; 29/25.16

[56] References Cited

U.S. PATENT DOCUMENTS

| | | | |
|---|---|---|---|
| 3,501,254 | 3/1970 | Niiland et al. | 431/359 |
| 3,602,619 | 8/1971 | Van der Tas | 431/362 |
| 3,627,459 | 12/1971 | Van der Tas et al. | 431/362 |
| 3,816,054 | 6/1974 | Baldridge, Jr. et al. | 431/362 |
| 3,872,560 | 3/1975 | Bock | 431/362 |
| 3,897,196 | 7/1975 | Saunders et al. | 431/362 |
| 3,959,860 | 6/1976 | Schindler | 29/25.16 |
| 3,969,067 | 7/1976 | Schupp | 431/362 |

FOREIGN PATENT DOCUMENTS 2504188 10/1975 Fed. Rep. of Germany ..... 431/362

*Primary Examiner*—Ronald H. Lazarus
*Attorney, Agent, or Firm*—D. S. Buleza

[57] ABSTRACT

The reliability of a photoflash lamp which is fired by a high-voltage pulse is improved by fabricating the flash-ignition mount from a glass bead, a glass sleeve and a pair of lead-in wires that have inwardly-bent end portions which define a gap of precise length that is uniform from lamp to lamp. The sleeve and bead are fused together and around parts of the lead-in wires such that only the bent tips of the wires protrude beyond the end face of the bead. The gap is filled with primer material that is deposited on the end face of the bead and completely covers the lead wire tips. The fused glass sleeve encloses one of the lead-in wires below the bead and is embedded in the envelope seal, thus not only insuring that the mount assembly is properly positioned within the envelope but insulating one of the lead-in wires and preventing the filling of combustible metal strands from accidentally touching both lead-in wires and internally short-circuiting the unfired lamp.

7 Claims, 12 Drawing Figures

PHOTOFLASH LAMP HAVING GAP-FIRE IGNITION MOUNT, AND METHOD OF MAKING THE MOUNT

BACKGROUND OF THE INVENTION

1. Field of the Invention

This invention relates to electric lamps and has particular reference to a photoflash lamp having an improved flash-ignition component.

2. Description of the Prior Art

Photoflash lamps which contain a filling of combustible fuel that is ignited by primer material that is disposed in a gap between the lead wires and subjected to a high voltage pulse are well known in the art. A photoflash lamp of this type having a pair of lead wires of unequal length that are held in spaced relationship by a side-vented glass sleeve that is anchored in the press seal of the envelope and surrounds the short lead wire and is terminated by a globule of primer material that covers the ends of both lead wires is disclosed in U.S. Pat. No. 3,873,260 issued Mar. 25, 1975 to Cote. A photoflash lamp that is fired in the same manner but contains a flash-ignition mount which includes a "donut-shaped" glass bead that joins the lead wires and is provided with a central opening that is filled with primer, and which optionally can also include a glass sleeve disposed around one of the lead wires below the bead to help prevent debris in the flashed lamp from shorting the lead wires, is disclosed in U.S. Pat. No. 3,884,615 issued May 20, 1975 to Sobieski.

A high-voltage type photoflash lamp having a flash-ignition mount that is similar to that shown in the aforementioned U.S. Pat. No. 3,873,260 but employs a glass sleeve which has no side vent opening and requires that the tip of the lead wire within the sleeve be melted so that it has a smooth rounded surface is disclosed in U.S. Pat. No. 4,008,040 issued Feb. 15, 1977 to Murray et al.

A photoflash lamp adapted to be ignited by applying a high-voltage pulse to primer material which bridges a pair of glass beads that enclose the lead wires and are supported by coatings of glass that surround the portions of the lead wires below the beads is disclosed in U.S. Pat. No. 3,501,254 to Nijland et al.

A photoflash lamp that is fired by passing an electric current through a filament supported by a mount structure which includes a glass bead that holds the lead wires in place and is provided by glass sheathes which enclose the lower portions of the lead wires to prevent after-flash shorting of the wires is described in U.S. Pat. No. 3,959,860 issued June 1, 1976 to Schindler. A similar type lamp which contains a flash-ignition mount having a non-shorting feature is shown in U.S. Pat. No. 3,816,054 issued June 11, 1974 to Baldrige, Jr. et al. The mount consists of a bead that joins the lead wires and has a glass sleeve that is located on top of the bead and encloses the upper extremity one of lead wires below the point at which it is joined to the primer-coated filament which is energized to fire the lamp. The use of a glass bead having a "stretched" or elongated upper surface that extends toward the primer-coated filament and thus prevents post-ignition short circuiting of the wires is disclosed in U.S. Pat. No. 3,919,750 issued Nov. 18, 1975 to Saunders et al.

SUMMARY OF THE INVENTION

While the prior art photoflash lamps provided various solutions to the problems of flash-reliability and preventing combustion debris from short circuiting the lead wires after the lamps are flashed and thus interferring with the sequential firing of the remaining lamps in a multiflash array such as the "Flipflash" units now being marketed, they are not entirely satisfactory with regard to maintaining a precise and uniform gap or spacing between the inner tips of the lead wires. This is a very important and critical factor in flashlamps that are fired by a high-voltage pulse since it not only controls the firing time of the lamp but determines whether or not the lamp will fire at all. If the gap is too long, then a weak voltage pulse will not be able to generate a spark that bridges the gap and ignites the primer material. If the gap is not kept uniform from lamp to lamp and within a preset tolerance, then the firing characteristic of the individual lamps will vary. This could cause operational difficulties in a multi-flash unit of the type in which the lamps are sequentially fired, or may also result in ruining the photograph due to improper exposure. The same problems can also be encountered if the lead wire tips embedded in the primer are oxidized during mount manufacture since this can drastically increase the resistance of the firing circuit.

Still another difficulty with the prior art mount structures is the fact that they use components that are rather difficult to assemble in the proper physical relationship on a mass-production basis and require rather large amounts of primer to fill the gap and cover the tips of the lead wires and hollow tubes, etc. that are employed. The use of such large quantities of primer material, in turn, creates another quality control problem in that voids or small pockets are sometimes left in the body of dried primer which prevent the lamp from firing, or cause very erratic firing.

The foregoing problems are avoided in accordance with the present invention by using a flash-ignition mount assembly that can be easily assembled from a small number of parts and provides a firing gap that is precisely controlled and kept uniform from lamp to lamp. The configuration of the mount is such that only small amounts of primer material are required to fill the gap and cover the tips of the lead wires, thus eliminating voids in the primer component and preventing the associated firing difficulties. These advantages are achieved by using lead-in wires of the same length, bending the inner ends toward each other and then holding the tips of the wires a precise distance apart by means of a solid glass bead that is fused around the lead wires and is shaped so that only the bent tips of the wires protrude beyond the bead. The end face of the bead is also made flat or slightly convex so that the protruding tips of the lead wires and the gap therebetween can be completely covered by a relatively thin layer of primer. In a preferred embodiment, a dimple-like crevice is also provided in the bead between the lead wire tips to form a mechanical interlock with the primer layer and thus firmly anchor it in place.

The improved mount is firmly held in proper position within the lamp envelope by a glass sleeve that surrounds the lower extremity of one of the lead wires and is fused to the underside of the bead and to the press seal formed on the end of the envelope. The segment of one of the lead wires that is disposed inside the lamp is thus entirely enclosed. This provides a "built-in" safeguard against inadverent short circuiting of the lead wires by one or more of the combustible metal strands before the lamp is fired. The glass sleeve is also of such size that it can be readily embedded in and merged with the press seal without creating any strains in the glass seal that could eventually cause it to crack and ruin the lamp.

A novel method of manufacturing the ignition mount using two glass sleeves of different size that are melted to form a fused bead-sheath component without oxidizing the bent ends of the lead wires is also provided.

BRIEF DESCRIPTION OF THE DRAWING

A better understanding of the invention will be obtained from the exemplary embodiments shown in the accompanying drawing, wherein.

DESCRIPTION OF THE PREFERRED EMBODIMENTS

Figure 1:
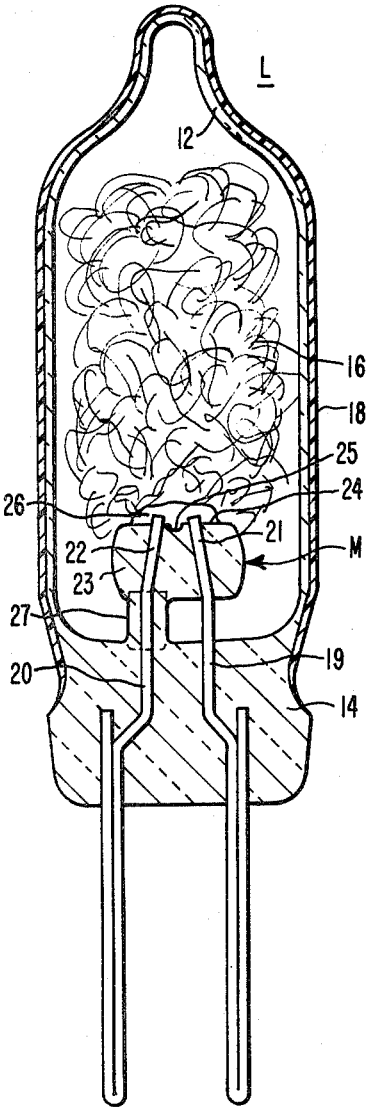
FIG. 1 is a side view, in cross-section, of a photoflash lamp embodying the invention.
Figure 2:
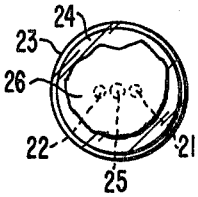
FIGS. 2 and 3 are plan and side elevational views, respectively, of the improved flash-ignition mount used in the lamp of FIG. 1.
Figure 3:
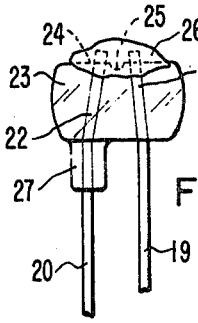
Figure 4:
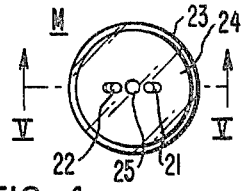
FIGS. 4 and 5 are similar views of the ignition mount before the primer material has been applied.
Figure 5:
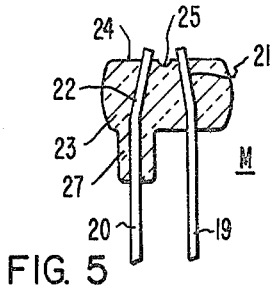

In FIG. 1 there is shown an all-glass photoflash lamp L which embodies the present invention and includes a tubular vitreous envelope 12 that is composed of a suitable transparent glass and is hermetically closed at its lower end by a press seal 14. In accordance with usual lamp-making practice, the envelope 12 is filled with an oxidizing atmosphere and a loose mass of combustible metal strands 16 that are composed of a suitable metal such as zirconium or hafnium that will produce a brilliant flash of light when ignited. The oxidizing atmosphere, as is customary, consists of oxygen at a pressure which provides a stoichiometric relationship with the fuel content of the mass of metal strands 16.

The lamp L contains the improved flash-ignition mount M of the present invention that is held in centralized position at the bottom of the envelope 12 and includes a pair of rigid lead-in conductors such as lead-in wires 19 and 20 that are embedded in the press seal 14 formed on the end of the envelope. To prevent the lamp L from exploding when it is fired, the envelope 12 is coated with a light-transmitting protective layer 18 of a suitable plastic such as cellulose acetate that is applied in the usual fashion well known to those skilled in the art.

As will be noted in FIG. 1 (and more particularly in FIGS. 2–5 which depict the flash-ignition mount M as a separate subassembly), the inner end portions 21, 22 of the lead wires are bent inwardly toward one another and are held in predetermined spaced-apart relationship by an insulator such as a solid glass bead 23 that is joined to and encloses medial portions of the lead wires 19, 20. The bead 23 is so shaped that the tips of the lead wires protrude only a short distance beyond the end face 24 of the bead and define a firing gap of predetermined length. In accordance with this embodiment, the end face 24 of the bead 23 is substantially flat except for a small indent or circular crevice 25 that is disposed between the protruding tips of the bent lead wire portions 21, 22. A layer 26 of a suitable primer material is deposited on the end face 24 of the bead 23 and completely covers the tips of the lead wires 19, 20 and extends into and completely fills the gap therebetween, as well as the indent 25 in the bead. Firing of the photoflash lamp L is achieved by applying a high-voltage pulse to the lead wires 19, 20 and producing a spark which jumps the gap between the lead wire tips and passes through the primer 26, causing it to ignite and trigger the rapid combustion of the metal strands 16.

In order to insure optimum flash-reliability, it is important the primer-covered bent tips of the leads wires 19, 20 be spaced a precise distance apart and that there be no voids or pockets in the body 26 of primer material. As a specific example, in the case of a miniature type photoflash lamp having a volume of about 0.6 millimeter and a tubular envelope approximately 9 millimeters in diameter and about 25 millimeters long (overall dimension) that is filled with shredded zirconium and oxygen at a pressure of about 5 atmospheres designed to be fired by a pulse of approximately 2000 volts, the spacing between the lead wire tips is maintained within the range of from about 0.38 to 0.51 millimeters. The bead is of circular cross-sectional configuration and has a diameter of about 4 millimeters. The lead wire tips protrude no more than about 0.26 millimeters above the flat end face of the bead and are completely covered by a primer that consists of a well-known mixture of finely-divided particles of zirconium and potassium perchlorate along with the suitable binder such as hydroxyethyl cellulose.

Since the bent tips of the lead wires 19, 20 extend but a short distance beyond the bead 23, only a very small amount of primer 26 is required to fill the firing gap and cover the lead wire tips. This permits the primer to be applied in one or two thin coats and insures that the primer layer 26 is free from any occluded air pockets or the like that would create voids. In addition to forming a mechanical interlock with the primer layer 26, the small indent 25 in the end face 24 of the bead 23 serves to increase the path along the surface of the bead 23 between the lead wire tips and assists in preventing combustion debris within the flashed lamp from shorting out the lead wires 19, 20.

As will be noted in FIG. 1, the flash-ignition mount M is securely anchored in the press seal 14 by a fused sleeve 27 of glass that has one end embedded in the seal, is fused around the medial portion of the lead wire 20 below the bead, and has its other end fused to the underside of the bead 23. The bead 23 is thus spaced inwardly from the press seal 14 and the glass sleeve insures that the inner segment of one of the lead wires (lead wire 20 in the embodiment illustrated) is completely enclosed. Accidental shorting of the lead wires 19, 20 inside the unfired lamp L by one or more of the metal strands 16 is thus prevented.

As will be noted in FIGS. 2 to 5, the lead wires 19 and 20, bead 23 and glass sleeve 27 are joined together to form an integral mount M which is subsequently sealed into the envelope 12 and anchored in the press seal 14 in the manner described.

Figure 6:
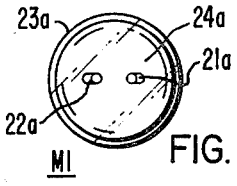
FIGS. 6–7 and 8–9 are plan and side elevational views, respectively, of alternative mount embodiments prior to the deposition of the primer material; and, FIGS. 10 to 10B are fragmentary views of three different stages in the manufacture of the ignition mount assembly shown in FIGS. 1 to 5.
Figure 7:
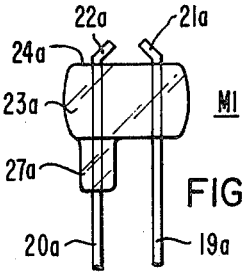

If desired, variations in the shapes of the leadin wires and glass bead can be made without departing from the spirit of the invention. For example, as shown in FIGS. 6 and 7, a modified mount $M_1$ can be provided by employing a bead **23*a* which has an end face 24*a* that is substantially flat and does not have an indent or crevice. The desired increase in the path along the end face of the bead between the lead wires 19*a* and 20*a* is achieved by shaping the lead wires in such manner that the portions which are embedded in the bead 23***a* are substantially straight and parallel to one another and the end portions 21*a* and 22*a* are located beyond the bead and are sharply bent toward each other and comprise the exposed tips of the wires. The length of the bent ends and the bend angle are such that the distance between the wires at the points where they emerge from the bead is at least twice the gap length.

Figure 8:
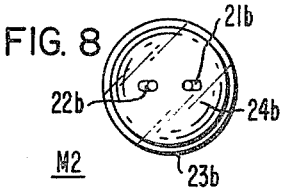
Figure 9:
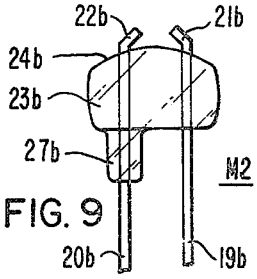

Alternatively, a modified flash-ignition mount $M_2$ of the type shown in FIGS. 8 and 9 can be employed wherein the bead 23*b* is provided with an end face 24*b* that is slightly convex and located below the protruding sharply-bent tips 21*b* and 22*b* of the lead wires 19*b* and 20*b*. As in the FIGS. 6–7 embodiment, the lead wire tips define a gap much smaller than the spacing between the embedded parts of the wires.

Figure 10:
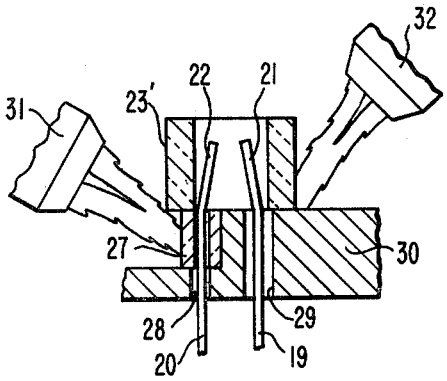
Figure 10A:
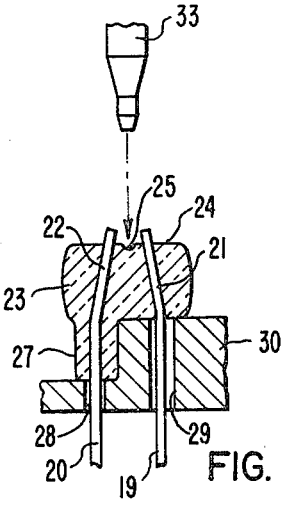

The manufacture of the flash-ignition mount is achieved in a very expedient and simple manner in accordance with the invention. As shown in FIG. 10, the preferred method consists of placing the lead wires 19 and 20 in the apertures or pockets 28 and 29 of a suitable fixture 30 so that the bent ends 21, 22 of the leads lie side-by-side facing one another. The glass sleeve 27 is then slipped over the lead wire 20 and seated on the fixture 30, and a larger glass sleeve 23' is placed in encircling relationship with the bent ends of both lead wires so that a part of its edge abuts against and is supported by the smaller sleeve 27 and its opposite edge portion is supported by an offset part of the fixture. The glass sleeves 23' and 27 are then heated by fires from suitably positioned burners 31 and 32 until the glass melts and the sleeves are fused together and collapse around the encircled parts of the lead wires. As shown in FIG. 10A, when this occurs the larger sleeve 23' automatically takes the form of a solid bead 23 of glass of such shape and dimensions that the tips of the bent ends 21, 22 of the lead wires 19, 20 protrude beyond the flat end face of the bead.

While the glass bead 23 is still in a molten condition, a jet of nitrogen (or other suitable non-oxidizing gas) is directed from a suitably positioned nozzle 33 onto the end face 24 of the bead 23 midway between the protruding tips of the bent lead wire portions 21, 22 to form a circular indent 25 without oxidizing the lead wires or the newly-formed bead.

Figure 10B:
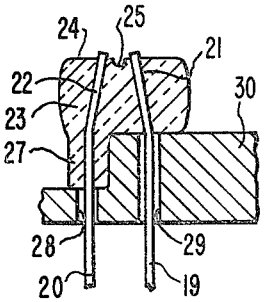

The molten glass is then allowed to cool and solidify, thus producing the finished mount M, as shown in FIG. 10B. The mount is subsequently inserted into the tubular envelope 12 and properly positioned therein so that only the end of the fused glass sleeve 27 is embedded in the press seal 14 which is formed on the end of the envelope. The layer 26 of primer is applied on the end face 24 of the bead 23 and over the protruding tips of the lead wires 19 and 20 by a suitable applicator that is inserted through the open top of the envelope 12 before the latter is loaded with the metallic fuel 16, charged with oxygen and tipped off.

As will be obvious to those skilled in the art, each of the mount-forming operations and the sealing-in operations, as well as the primer application, can be achieved in sequence at various stations of an automatic lamp-making machine. As shown in FIG. 10, melting of the glass sleeves 23' and 27 into a single mass of fused glass is achieved by heating them in such a manner that the lead wires 19 and 20, especially their tips, are not exposed to the fires and their oxidizing effect.

We claim as our invention:

1. In combination with a photoflash lamp that is adapted to be ignited by a voltage pulse and has a firing gap the length whereof affects the firing characteristics of the lamp and is thus desirably maintained within a predetermined dimensional tolerance, said lamp having a glass envelope that contains an oxidizing atmosphere and a mass of strand-like combustible fuel and is terminated at one end by an hermetic seal, means for igniting said fuel and producing a flash of light when a high-voltage pulse is applied to the lamp, said flash-ignition means comprising;

a pair of rigid lead-in wires embedded in said hermetic seal and extending into said envelope in spaced side-by-side relationship therewithin, the inner end portions of said wires being of substantially equal length and so arranged that the tips thereof are separated by a small gap having a length that is within said predetermined dimensional tolerance, a single insulator within said envelope holding the lead-in wires in such gap-defining position, said insulator comprising a solid glass bead that is joined to medial parts of both of the lead-in wires and is so shaped that the tips of the wires protrude beyond the end face of the insulator bead toward the contained mass of fuel and the opposite face of the bead is spaced from the hermetic seal portion of the envelope, a glass sleeve surrounding the part of only one of said lead-in wires that extends from said hermetic seal to said insulator bead, said sleeve being fused to said bead and also to said hermetic seal and thus completely enclosing the said part of the lead-in wire so that only one of said pair of lead-in wires is electrically isolated from the mass of strand-like fuel and said sleeve also provides rigid support means for the insulator bead and the gap-defining tip portions of the lead-in wires, and a layer of primer material disposed on and bonded to the end face of the insulator bead and completely covering the tips of said lead-in wires and extending into and filling the firing gap therebetween.

2. The photoflash lamp of claim 1 wherein;

said combustible fuel comprises a mass of metal strands, the gap-defining tips of said lead-in wires are bent toward another, and the end face of said insulator bead is substantially flat and has a dimple-like recess therein that is located between the protruding tips of the lead-in wires and is also filled with primer material.

3. The photoflash lamp of claim 1 wherein;

the medial parts of said lead-in wires that are joined to and enclosed by the insulator bead are disposed in substantially parallel relationship, and the tips of said lead-in wires are sharply bent toward one another so that the distance between said wires at the points where they emerge from said bead is at least twice as long as the gap length.

4. The photoflash lamp of claim 3 wherein the end face of said insulator bead is substantially flat and is substantially covered by the layer of primer material.

5. The photoflash lamp of claim 3 wherein the end face of said insulator bead is convex and is substantially covered by the layer of primer material.

6. The photoflash lamp of claim 1 wherein;

said envelope is of tubular configuration and said hermetic seal comprises a press seal of fused glass, and said glass sleeve is fused to said insulator bead, the associated lead-in wire and the press seal.

7. In the manufacture of a photoflash lamp of the type that is ignited by a voltage pulse and thus requires a firing gap of precisely-controlled length, the method of fabricating a flash-ignition mount assembly adapted to be sealed within a vitreous envelope along with a combustible filling of strand-like fuel, which method comprises;

forming a pair of rigid lead-in wires that have bent end portions, holding said lead-in wires in spaced side-by-side position so that the tips of said bent end portions extend toward one another and define a firing gap of predetermined length, placing a first glass sleeve in encircling relationship with a medial part of only one of said lead-in wires that is disposed adjacent the bent end portion thereof, said first glass sleeve being of such length that it also extends over a portion of said one lead-in wire that will subsequently be located within the sealed segment of the envelope of the finished lamp, placing a second glass sleeve of larger dimensions in encircling relationship with the bent end portions of both of said lead-in wires so that edge portions of said glass sleeves abut one against the other, heating said glass sleeves until they melt and fuse together to form a solid bead and an integral protective sheath of such size and configuration that they enclose the encircled parts of said lead wires, except for the bent tips thereof, with the sheath being of such length that it will be anchored in the sealed segment of the envelope during the sealing-in operation required to complete the lamp, and thus form an electrical insulator that encloses only one of said pair of lead-in wires allowing the molten glass to solidify and form a unitary mount assembly, and then depositing a sufficient quantity of primer material on the end face of said bead that is located opposite the glass sheath to completely cover the protruding tips of the lead-in wires and fill the firing gap therebetween.

* * * * *